US008277086B2

(12) United States Patent
Heitmann

(10) Patent No.: US 8,277,086 B2
(45) Date of Patent: Oct. 2, 2012

(54) ROUND REFLECTOR FOR ELECTROMAGNETIC RADIATION

(75) Inventor: Dietrich Heitmann, Gevelsberg (DE)

(73) Assignee: Alux Luxar GmbH & Co. KG, Korschenbroich (DE)

( * ) Notice: Subject to any disclaimer, the term of this patent is extended or adjusted under 35 U.S.C. 154(b) by 330 days.

(21) Appl. No.: 12/717,971

(22) Filed: Mar. 5, 2010

(65) Prior Publication Data

US 2010/0246189 A1 Sep. 30, 2010

(30) Foreign Application Priority Data

Mar. 25, 2009 (DE) ..... 20 2009 004 003 U
Nov. 24, 2009 (DE) ..... 20 2009 016 032 U

(51) Int. Cl.
*F21V 7/00* (2006.01)

(52) U.S. Cl. ..... 362/297; 362/322; 362/283; 362/346; 362/321; 362/341

(58) Field of Classification Search ..... 362/322, 362/321, 320, 297, 283, 341, 346
See application file for complete search history.

(56) References Cited

U.S. PATENT DOCUMENTS

| | | | | |
|---|---|---|---|---|
| 1,654,974 | A * | 1/1928 | Johnson | 362/292 |
| 2,586,583 | A * | 2/1952 | Wagner | 362/346 |
| 2,806,134 | A * | 9/1957 | Tarcici | 359/853 |
| 4,855,884 | A * | 8/1989 | Richardson | 362/278 |
| 5,198,832 | A * | 3/1993 | Higgins et al. | 343/915 |
| 6,024,469 | A * | 2/2000 | Greif | 362/346 |
| 6,464,378 | B1 * | 10/2002 | Reed et al. | 362/320 |
| 7,452,111 | B2 * | 11/2008 | Mazzei | 362/346 |
| 8,025,430 | B2 * | 9/2011 | Natan et al. | 362/322 |

* cited by examiner

*Primary Examiner* — Anabel Ton
(74) *Attorney, Agent, or Firm* — Andrew Wilford

(57) ABSTRACT

A reflector has a one-piece sheet-metal body having an anodized front face and unitarily formed with a central annular part lying generally in a plane and having an inner periphery generally centered on an axis and adapted to accommodate a light source and an outer periphery. A plurality of flat fingers project from the outer periphery, extend at an acute angle to the plane, have outer ends, and each have a pair of generally parallel side edges. Each edge of each finger is closely juxtaposed with the edge of the adjacent finger and the fingers form with the annular part a concave shape.

27 Claims, 7 Drawing Sheets

4
2
5
3
3
A
2
1

2
2
2
2
2
2
2
A

ROUND REFLECTOR FOR ELECTROMAGNETIC RADIATION

FIELD OF THE INVENTION

The present invention relates to round reflector for electromagnetic radiation. More particularly this invention concerns such a reflector used in a light fixture or to reflect light.

BACKGROUND OF THE INVENTION

In prior art, such reflectors are known. For example, for lighting the reflectors reflect the radiant power from a light source to an object or a surface that is to be illuminated. A number of lamp types are available to do this having various technologies for generating the corresponding radiant power. These are, for example, filament bulbs or halogen lamps, fluorescent lamps or compact fluorescent lamps, metal halogen vapor lamps or sodium vapor lamps, as well as also induction lamps.

The radiation from the lamp bounces off the reflector whose shape is determined the pattern of light emitted by the lamp, i.e. the lamp filaments or the output of the lamp. The spatial vectors, angles of light incidence and reflection, relative to the perpendicular to the reflector surface.

Different lamps have different shapes. There are, for example, very compact filaments in the case of low-voltage halogen lamps, elongated filaments for rod-shaped high voltage halogen lamps, glowing thin glass tubes in fluorescent lamps or glass tube bundles in compact fluorescent lamps and very small cylindrical outputs for the emitters of metal vapor lamps, as well as U-shaped or helical discharge tubes for flash bulbs.

The surface of the reflectors can be mirror finish smooth or have an array of regular or irregular surface structures. Reflectors have different photometric tasks, for example, a distribution of light intensity of small of, for example, 10°, of spot or medium of 30°, or of flood of 60°.

So that the reflectors and the radiant power of the lamps can reflect in such a way that the desired objects are illuminated with the proper light, the reflectors solve several problems.

The reflectors are developed and manufactured in such a way that the desired distribution of the intensity of light can be achieved by the reflector shape. Thus, efficiency is important in that the reflector can absorb a tolerable maximum of radiant power of the lamp. Only a minimum of multiple reflections should be emitted from the lamp to the reflector and back again to the lamp and then toward the outside. For rod-like long lamps this is a problem axially in the round reflector because when the reflector shape in the direction of the rear side reflector axis is not perfect, the degree of effectiveness can be significantly diminished. The radiant power of the lamp reaches the outside only after several reflections in many wrong directions between the reflector and the lamp.

The various lamp types generate nonhomogeneous radiant power with respect to light intensity of light, as well as light color. Illumination must be even with no color spots created on the objects that are to be illuminated. As a rule, the reflector has a surface that has as high a total reflectivity as possible for the degree of effectiveness of the lamp. But a part of the reflection must be diffuse in order to mix the nonhomogeneous radiation of the lamps, irregularities in the reflector and small assembly errors in the lamp position.

The production of round reflectors concerned here starts with blanks in a spin-shaping process. The spinning tool has the reflector shape, that is the reflector surface is on the spinning tool. This is done by means of sand blasting, erosion, form shaping as per photo specifications, by cutting and in the past also by embossing. The spinning process is a very old technology. Only one reflector per spinning machine can be made at a time. The technology has very high labor costs.

An additional technology for the production of reflectors is tension-compression shaping. During deep drawing, a sheet metal blank is fixed in a die and shaped by a drawing punch in one or more steps into a hollow body. For hydro-mechanical deep drawing, the reflector is created as the result of the drawing punch, subject to the influence of the pressure of a pressure medium. In the case of the hydroshaping process, a membrane protects the future reflector from the pressure medium.

After the spinning process, the reflector must be chemically treated. Its surface must be able to reflect the light with as little absorption as possible, and must also be covered with a protective layer against corrosion. In the interest of the reflection with a minimum of absorption, the purest aluminum is also used in plated form. Brightness is created as the result of anodic brightness with the assistance of continuous current in electrochemical systems. The layer of protection against corrosion is created by anodic oxidation. But this oxidation of the reflector surface also has low diffuse reflection and absorption properties. As a result of additives in the electrochemical baths, the oxide layer is usually colored, so that these subsequent chemical treatments of the reflector surface decrease the effectiveness of the lamp by a small amount. Beyond that, the application of electrochemical baths is a difficult and environmentally damaging technology, but in the case of round reflectors that are produced by spinning, it is indispensable.

There are channel or box reflectors. These are cut from strip material, stamped or lasered. These strip materials have a finished surface. The surface structure is rolled into the flat blank. The total reflection and thus the degree of effectiveness of the lamp is significantly better than in the reflectors mentioned above that are made of blanks or precut parts of untreated aluminum.

OBJECTS OF THE INVENTION

It is therefore an object of the present invention to provide an improved round reflector for electromagnetic radiation.

Another object is the provision of such an improved round reflector for electromagnetic radiation that overcomes the above-given disadvantages, in particular that is more cost-effective to manufacture while the inventive highly effective round reflectors have an improved efficiency that also allows lamp design to be influenced in an easy manner.

A further object is to overcome environmental problems by not requiring electrochemical baths while facilitating automated production and to make possible reflector/lamp combinations that cannot be realized with the previously customary technology.

Finally the reflector according to the invention should be particularly easy to handle and to assemble.

SUMMARY OF THE INVENTION

A reflector has according to the invention a one-piece sheet-metal body having an anodized front face and unitarily formed with a central annular part lying generally in a plane and having an inner periphery generally centered on an axis and adapted to accommodate a light source and an outer periphery. A plurality of flat fingers project from the outer periphery, extend at an acute angle to the plane, have outer ends, and each have a pair of generally parallel side edges.

Each edge of each finger is closely juxtaposed with the edge of the adjacent finger and the fingers form with the annular part a concave shape.

With this technology, the previously customary production of round reflectors is replaced, in that a blank consists of anodized aluminum sheet metal cut or lasered in such a way that starting from a middle part of the blank, fingers project in a stellate pattern. These fingers can be bent easily into a reflector form so that then a round reflector is formed.

The photometrically generated results from a conventional round reflector and the reflector in accordance with the invention are practically equal for both construction types with respect to the distribution of the light intensity. The same lamp, i.e. light source, is used as well. Even the reflector diameter, reflector height and focal point are the same as in conventional constructions. The reflector in accordance with the invention has, however, the important advantage that its degree of effectiveness is significantly higher, as the reflector material used is pre-anodized strip material. The previously customary spinning processes including the environmentally damaging baths are eliminated.

The precut part of the corresponding blank with the fingers can be made of strip material. This way, the photometrically best reflector qualities can be used without restriction. The advantage of the better degree of effectiveness is the consequence of the bettor reflector surface with higher total reflection. Gas discharge lamps require a share of diffuse light diffusion. These surface qualities are to be considered in manufacture. The finished precut part is bent with a tool having the desired reflector shape. Each finger of the precut part corresponds to a partial reflector.

Depending on the application it can be advantageous when the side edges of the fingers overlap each other. This way light-permeable gaps of the reflector are avoided.

In addition, the fingers are connected with each other at their ends. As a result the desired bent reflector form is definitively fixed by connection of the fingers at their ends. According to the invention adjacent fingers are connected by fasteners such as, screws, plugs, snaps, or are riveted or welded, the fasteners being provided at the outer ends of the fingers remote facing away from the central part. The individual fingers of the reflector star can also be connected with each other by hooks.

Preferably, one side edge of the fingers extends radially and the other side edge is curved away from the radially aligned edge so that in the completely bent reflector it covers the adjacent radial side edge of the adjacent finger.

The geometry of the partial reflectors of the precut part is the consequence of the photometric problem. One side edge of each finger is thus a steady curve.

The reflector in accordance with the invention for light and electromagnetic radiation has the function of a round reflector. It is, however, actually of polygonal shape.

A preferred further development under certain circumstances is that the fingers are planar. In this manner, individual reflections are formed exactly by the individual fingers that fan out the light of the reflector, sparsely in the center of the reflector and more toward the edge. The evenness of the distribution of light intensity is thereby improved.

An alternative embodiment is that the fingers are formed convex in cross section. The convex individual reflectors spread out the light of the reflector more toward the outside than in the case of the reflector with flat individual reflectors. This type of design with convex individual reflectors is preferably used when the lamp is limited in the installation height for the reflector, if, for example, space is desired only at the installation height for a spot reflector, but a flood reflector, which is normally significantly higher, is to be installed as well. The reflector concept in accordance with the invention can thus be used in versatile manner and can solve photometric problems that cannot be solved with conventional reflectors.

A further alternative is that the fingers are formed concave in cross section. According to this embodiment, the concave individual reflectors spread the light of the reflector outward crosswise. This design with concave individual reflectors is preferably used when the lamp is limited to an installation height for the reflector.

A further preferred embodiment is that the fingers form a linear angle shape in cross section, for example, a triangle. In this manner, an additional spreading out is also achieved for each individual reflector and additional reflectors. Here as well, the sections of each individual reflector spread out the light of the reflector more toward the outside than in a reflector with flat individual reflectors. This design can also find application when the lamp is limited at the installation height for the reflector. If, for example, at the installation height there is only room for a spot reflector, but a flood reflector, which is normally significantly higher, is needed. The reflector in accordance with the invention can be used and solve this photometric problem.

In addition, the fingers are connected by a bent edge directed tangential to the central part. This bent edge can forms an small acute angle with a tangent to the central part. This way, the individual fingers are not located tangentially but are, so to speak, rotated against the tangential arrangement, so that in the cross section shape a saw tooth-shaped arrangement is created. As a result of this, light is not reflected directly back again into the illumination means, but laterally past it so that a greater efficiency is achieved.

Further, at least 6 and at most 24 fingers are connected to the central part that are distributed evenly over the circumference of the central part.

It can also be provided that each finger is faceted on its surface. Moreover, each finger forms a free-form surface. The free ends of the fingers form an angled flange, and the flange of all fingers—in the completely bent condition of the fingers—forms a circumferential circular flange edge.

Further, the fingers are arranged alternately is overlapping each other with the side edges. The fingers can also abut each other at their adjacent side edges.

Especially preferred, the reflector consists of one piece of sheet metal anodized on one face, particularly aluminum sheet metal, the surface that acts as reflector being rolled to high gloss, finished, brushed fine matte, beveled, or etched matte.

In addition, the fingers are formed as trapezoid that broaden from the central part toward the free ends.

The central part in accordance with the invention is perforated in the center and that an electrical light source is fitted in the hole. In this way, the socket for a corresponding light source can be inserted in the perforation, for example, and the light source can be inserted into this socket at the desired position relative to the reflector and installed on the reflector.

In order to make handling and assembly easier, a ring can be slid onto the reflector or is slid on and can be fixed. After the fingers have been bent into a round reflector form, a ring is slid onto the fingers and affixed on their back faces. As a result of this, deformation of the fingers toward the outside is prevented and on the other hand, handling of the entire reflector is made easier.

Further, especially preferred, the ring is circular and has at least one, preferably two or more inwardly projecting snap tabs at the inner edge that engage with cutouts formed in the reflector and fit onto the reflector from the back into the intended assembly position, and retain the ring at the reflector.

By means of a ring that is slid onto the reflector in this way, the stability of the reflector is significantly increased and the assembly is thereby particularly easy to handle and install.

Thereby, especially preferred, three such cutouts are distributed angularly uniformly around the reflector, and three complementary snap tabs that are formed on the ring engage in the intended assembly position. Hence because the three cutouts are evenly distributed over the circumference of the reflector, a safe retention of the ring that is slid onto the reflector is ensured. In this process, it can be especially preferred that the cutouts are formed by identical notches that face each other in the side edges of two adjacent, abutting fingers.

The diameter of the outer edge of the ring is larger than the maximum diameter of the reflector or smaller than the maximum diameter of the reflector. Depending on the installation situation of the reflector, the ring can have diameters of various sizes.

It is possible, for example, to support the reflector by means of the ring at additional construction components.

Finally, especially preferred, the ring consists of stamped flat stock. As a result, a cost-effective and easy production of the ring is made possible by stamping it out of flat stock.

BRIEF DESCRIPTION OF THE DRAWING

The above and other objects, features, and advantages will become more readily apparent from the following description, reference being made to the accompanying drawing in which:

FIGS. 10, 12, and 13 are views like respective FIGS. 8, 9, and 10 of another reflector in accordance with the invention.

SPECIFIC DESCRIPTION

Figure 1:
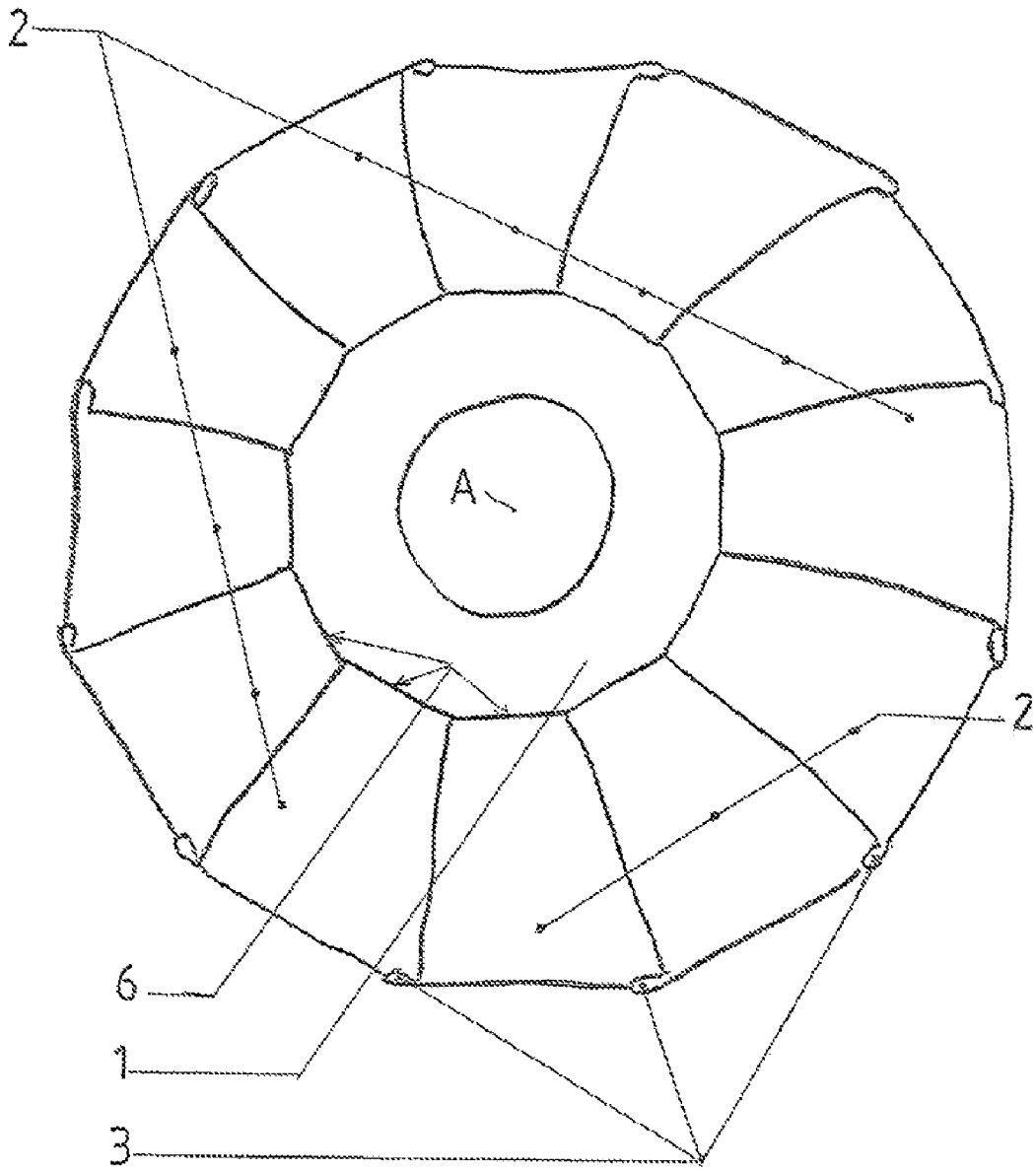
FIG. 1 is a reflector according to the invention in a top view seen from the front.
Figure 2:
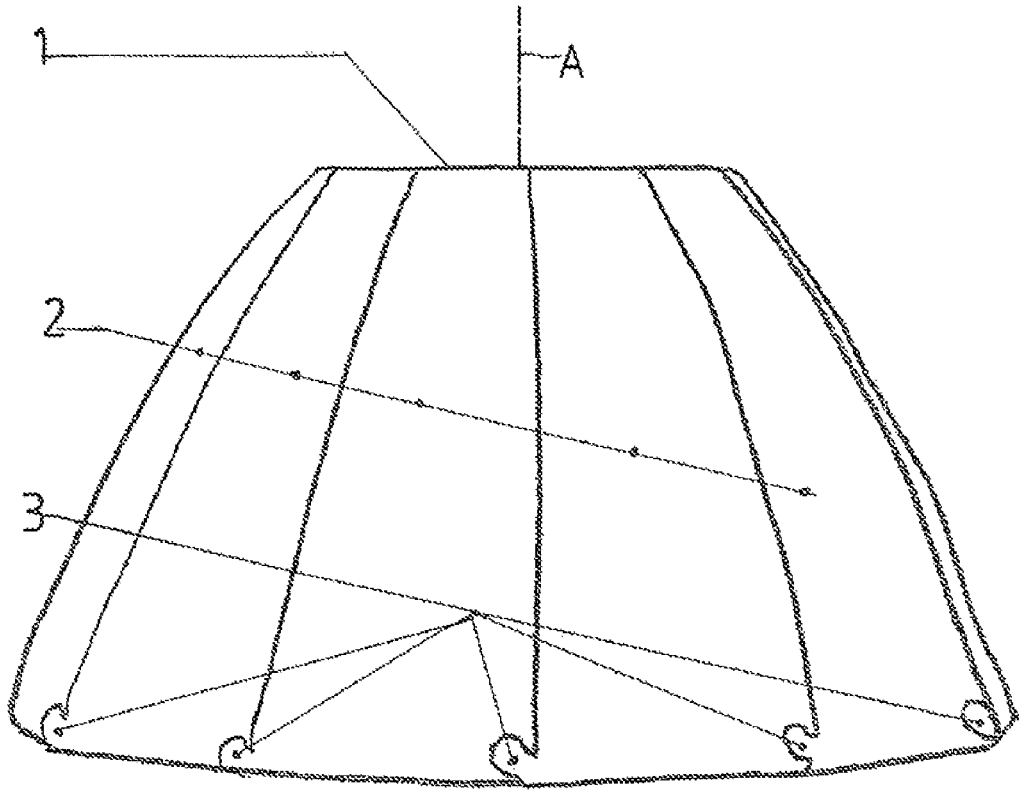
FIG. 2 is the FIG. 1 reflector in a side view.
Figure 3:
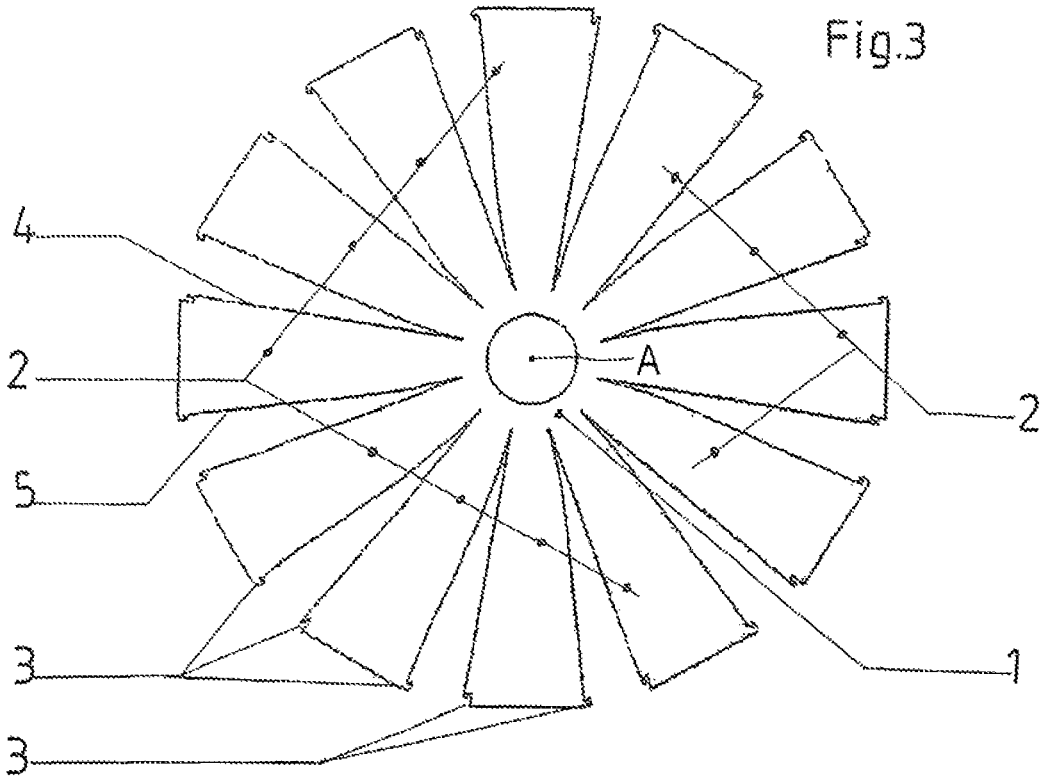
FIG. 3 is a top view of a precut workpiece or blank form making the reflector of FIGS. 1 and 2.

FIGS. 1 and 2 show a round reflector for light made from a blank shown in FIG. 3. This blank is made of very thin aluminum sheet metal that is anodized on the front reflecting face. Flat fingers 2 project radially relative to a center axis A from the outer periphery 6 of a planar and annular central part 1 of the blank and are bent into the shape of a reflector in a subsequent shaping process, as clearly shown in FIGS. 1 and 2. Thus, the side edges of the fingers 2 are overlap each other so that no gaps are created. In addition, the fingers 2 are connected with each other at their outer free ends by fasteners 3. As can be seen particularly in FIG. 3, one side edge 4 of fingers 2 extends perfectly radially while the other side edge 5 has a curve away from the radial edge 4, so that it overlaps the adjacent radial side edge 4 of the adjacent finger 2 in the complete reflector. The outer edges of the fingers lie, prior to deformation of the blank forming the reflector from its initial planar shape, on a circle centered on the axis, that is outwardly part-circularly convex.

Figure 4:
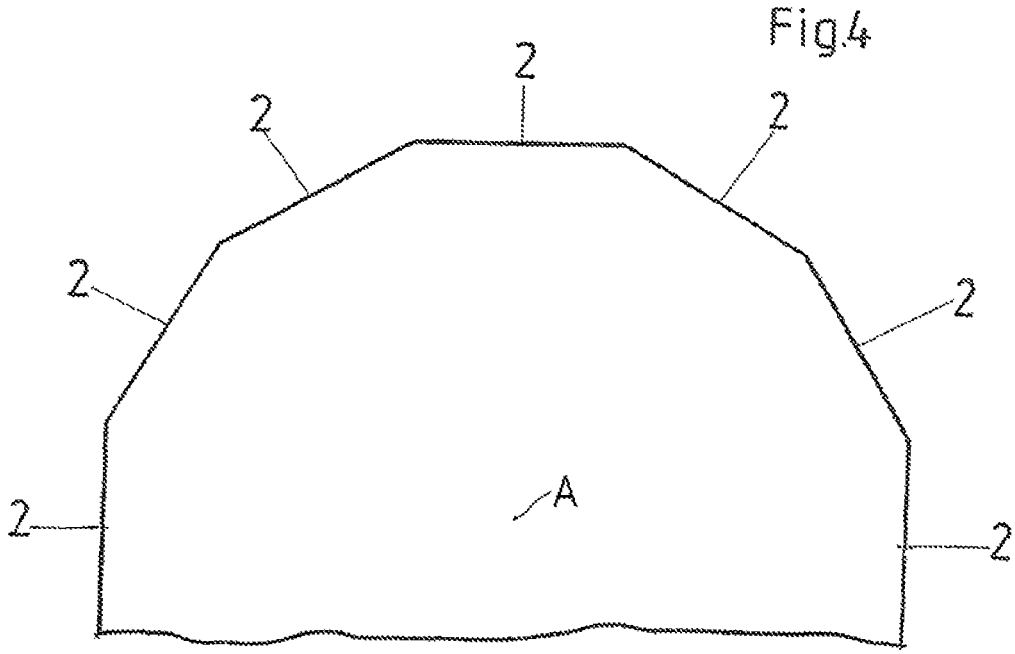
FIGS. 4 to 7 are schematic rear views illustrating different shapes of the reflector according to the invention.
Figure 5:
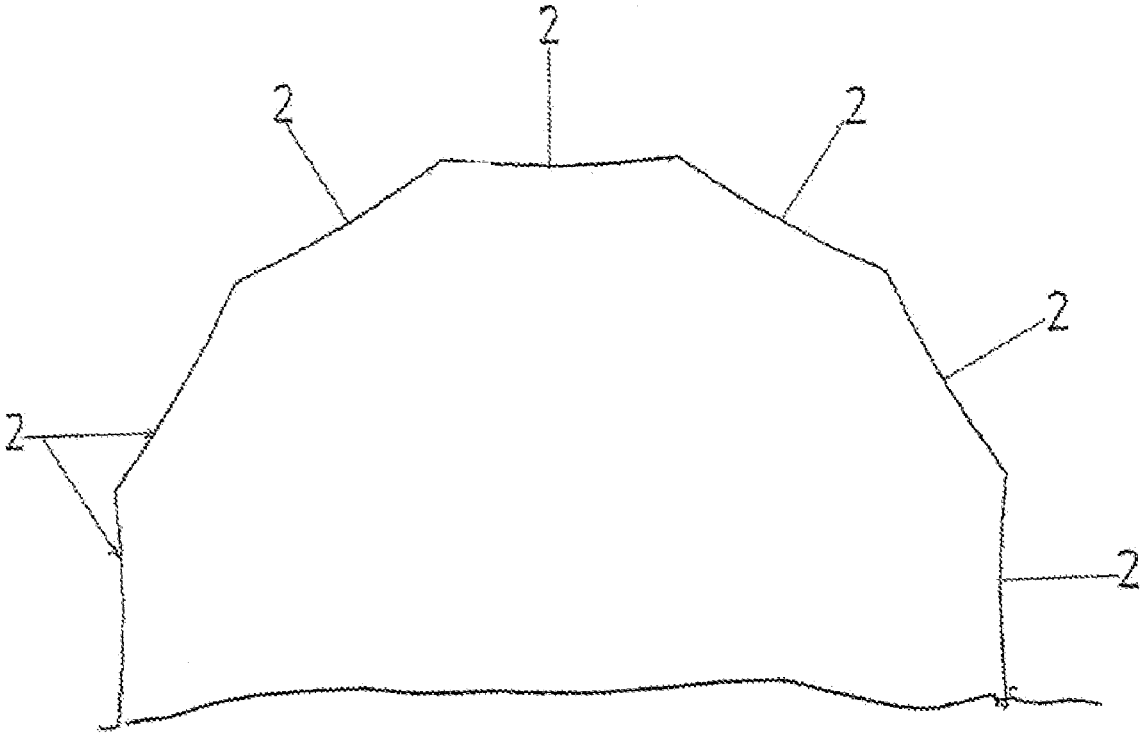
Figure 6:
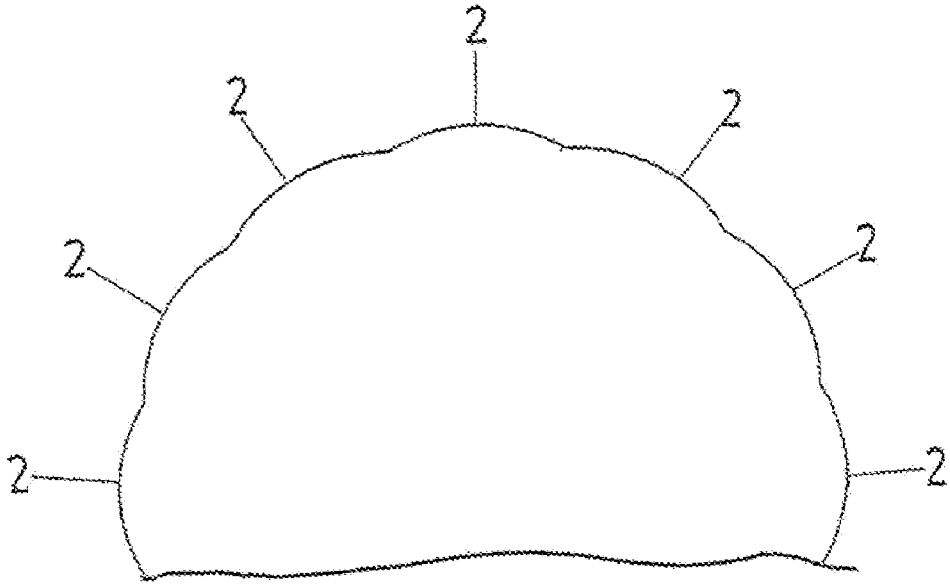
Figure 7:
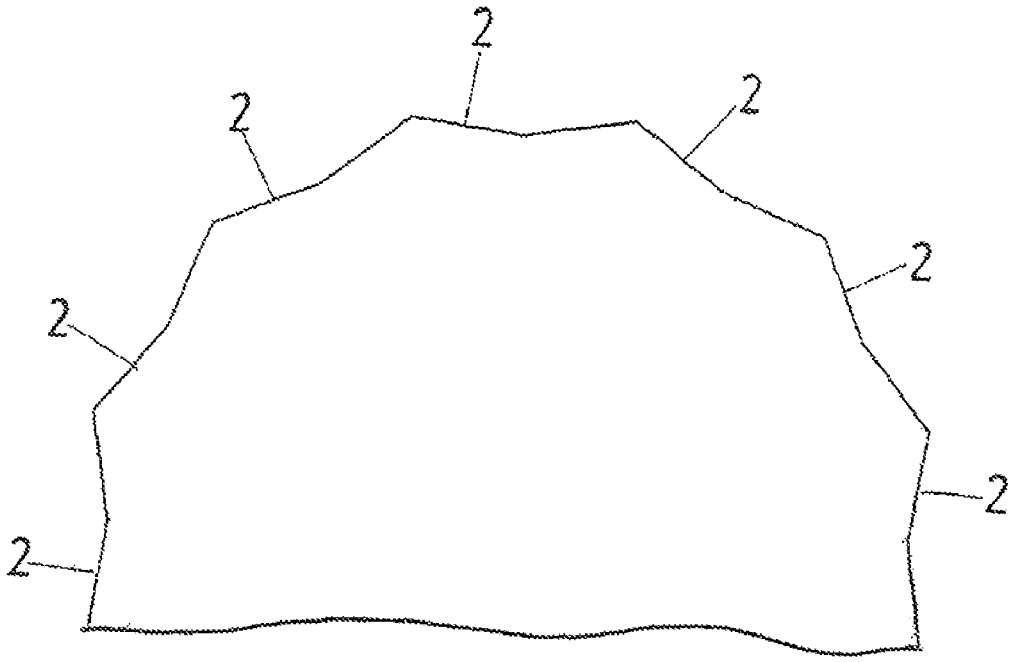

In the embodiment according to FIG. 4, a view is shown in which the fingers are planar. In the embodiment according to FIG. 5, the fingers are formed inwardly convex in cross section. In the embodiment according to FIG. 6, the fingers are formed inwardly concave in cross section. In the embodiment according to FIG. 7, the fingers are as V-shaped seen in end view, that are each formed of two flat sections that meet at a central line.

Preferably, the fingers are connected to the central part 1 at a straight line extending tangentially of the outer periphery 6 of the central part 1.

In the illustrated embodiments, 24 identical fingers are connected to the central part 1 and distributed uniformly is over the outer periphery of the central part 1.

Figure 9:
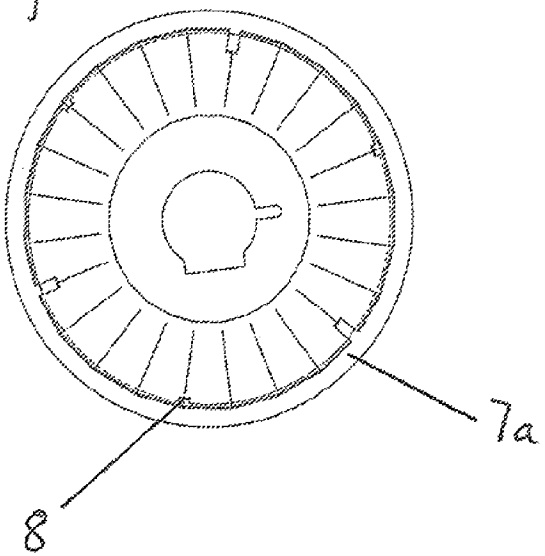
FIGS. 8, 9, 10 respective are perspective, front, and back views of a reflector according to the invention.
Figure 10:
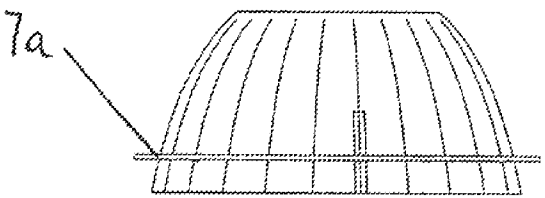
Figure 8:
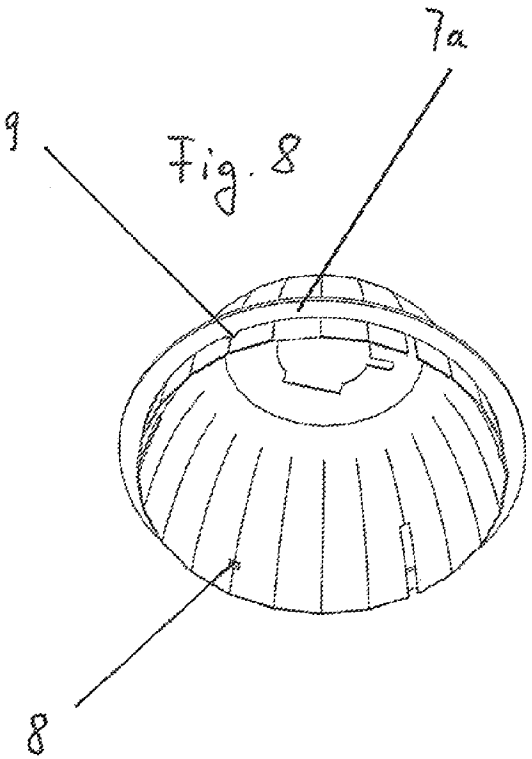

FIGS. 8 to 13 show how a ring 7*a* or 7*b* 7*b* can be slid from the outside and affixed near the outer ends of the fingers 2. Each ring 7*a* or 7*b* is circular and is provided on its inner edge in FIGS. 8-10 with three angularly equispaced snap tabs 9 that are extend inward. These tabs 9 engage in respective rectangular cutouts 8 cut into overlapping side edges 4 and 5 of the fingers at a spacing from their outer ends so that they replace the fasteners 3 that hold the reflector in the desired cup shape. A reflector of this type with a slid-on ring 7*a*, is particularly easy to handle and especially easy to assemble, and also it has especially high stability. In FIGS. 8 to 10, the diameter of the outer edge of the ring 7*a* is larger than the maximum diameter of the reflector at the outer ends of the fingers 2.

Figure 12:
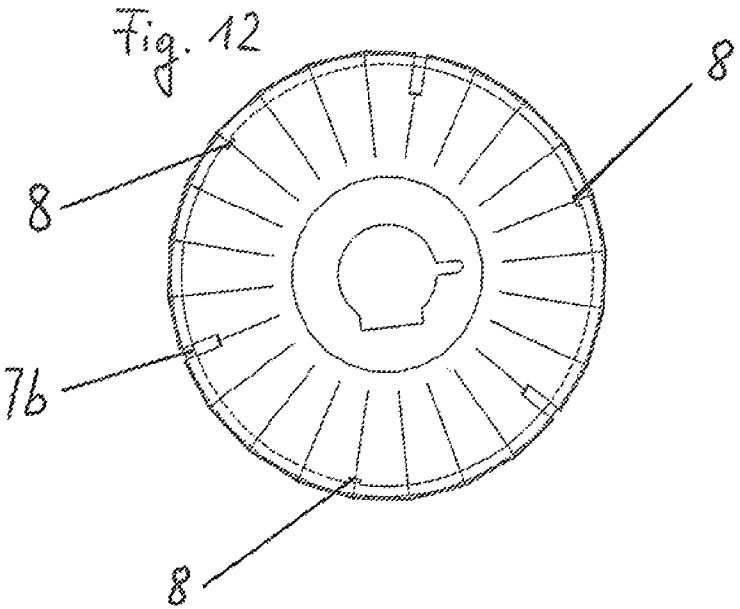
Figure 13:
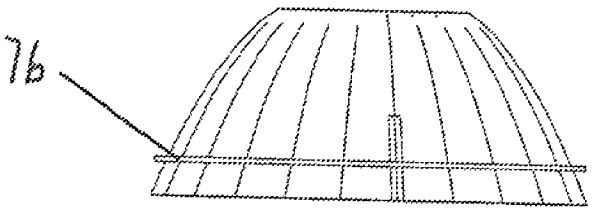
Figure 11:
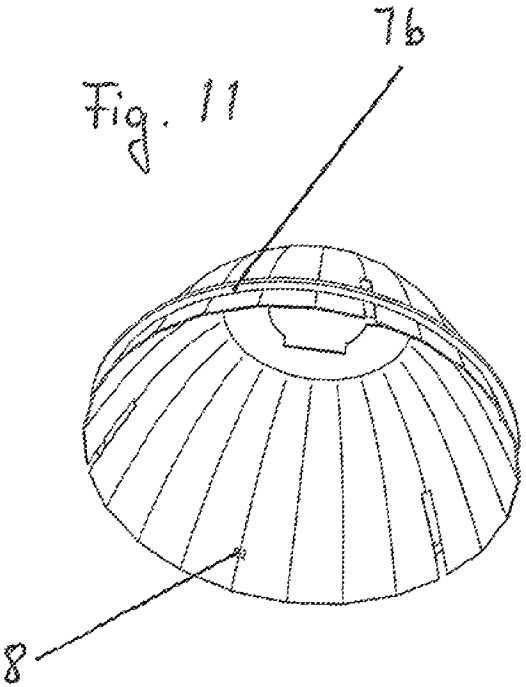

In FIGS. 11 to 13, the diameter of the outer edge of ring 7*b* is smaller than the maximum diameter of the reflector, but otherwise this embodiment is identical to that of FIGS. 8-10.

Depending on the housing into which the reflector is installed, the outer diameter of ring 7*a* or 7*b* can thus be larger or smaller than the outer diameter of the reflector in order to, for example, abut housing sections or to be supported by the housing.

The rings 7*a* and 7*b* consist of stamped flat stock, as a result of which the production costs are low.

The invention is not limited to the illustrated embodiments, but is variable within the scope of the disclosure.

All new individual and combination characteristics that are revealed in the description and/or drawing are viewed as being essential to the invention.

I claim:

1. A reflector comprising:

a one-piece sheet-metal body having an anodized front face and unitarily formed with a central annular part lying generally in a plane and having an inner periphery generally centered on an axis and adapted to accommodate a light source and an outer periphery, and a plurality of flat fingers projecting from the outer periphery, extending at an acute angle to the plane, having outer ends, and each having a pair of generally parallel side edges, each of the fingers being trapezoidal and of a width increasing outward from the central part; and means holding the fingers with each edge of each finger closely juxtaposed with the edge of the adjacent finger and the fingers forming with the annular part a concave shape.

2. The reflector defined in claim 1 wherein the edges overlap.

3. The reflector defined in claim 1 wherein the means fix together the fingers at the outer ends.

4. The reflector defined in claim 3 wherein the means includes respective fasteners securing each of the fingers at one of its side edges to the side edge of the adjacent finger.

5. The reflector defined in claim 1 wherein one of each of the side edges of each finger is straight and extends substantially radially of the axis and the other of the side edges of each finger is curved and overlaps the straight side edge of the adjacent finger.

6. The reflector defined in claim 1 wherein each of the fingers is substantially planar.

7. The reflector defined in claim 1 wherein each of the fingers is inwardly convex.

8. The reflector defined in claim 1 wherein each of the fingers is inwardly concave.

9. The reflector defined in claim 1 wherein each of the fingers is formed by two substantially planar sections each defining a respective one of the side edges and both meeting at a generally central straight line.

10. A reflector comprising:

a one-piece sheet-metal body having an anodized front face and unitarily formed with a central annular part lying generally in a plane and having an inner periphery generally centered on an axis and adapted to accommodate a light source and an outer periphery, and a plurality of flat fingers projecting from the outer periphery, extending at an acute angle to the plane, having outer ends, and each having a pair of generally parallel side edges, the outer periphery being circular and centered on the axis and each of the fingers meets the central part at a straight bend line extending tangentially of the outer periphery; and means holding the fingers with each edge of each finger closely juxtaposed with the edge of the adjacent finger and the fingers forming with the annular part a concave shape.

11. The reflector defined in claim 10 wherein each bend line forms with the outer periphery a small acute angle.

12. The reflector defined in claim 1 wherein there are at least 6 and at most 24 such fingers angularly substantially equispaced about the axis.

13. The reflector defined in claim 1 wherein the front face of each finger is formed with facets.

14. The reflector defined in claim 1 wherein each finger has a free form surface.

15. A reflector comprising:

a one-piece sheet-metal body having an anodized front face and unitarily formed with a central annular part lying generally in a plane and having an inner periphery generally centered on an axis and adapted to accommodate a light source and an outer periphery, and a plurality of flat fingers projecting from the outer periphery, extending at an acute angle to the plane, having outer ends, and each having a pair of generally parallel side edges, the outer ends of the fingers forming an angular flange that in a completely bent condition of the fingers forms a circumferential circular flange edge; and means holding the fingers with each edge of each finger closely juxtaposed with the edge of the adjacent finger and the fingers forming with the annular part a concave shape.

16. A reflector comprising:

a one-piece sheet-metal body having an anodized front face and unitarily formed with a central annular part lying generally in a plane and having an inner periphery generally centered on an axis and adapted to accommodate a light source and an outer periphery, and a plurality of flat fingers projecting from the outer periphery, extending at an acute angle to the plane, having outer ends, and each having a pair of generally parallel side edges, the fingers alternately overlapping each other at the side edges; and means holding the fingers with each edge of each finger closely juxtaposed with the edge of the adjacent finger and the fingers forming with the annular part a concave shape.

17. A reflector comprising:

a one-piece sheet-metal body having an anodized front face and unitarily formed with a central annular part lying generally in a plane and having an inner periphery generally centered on an axis and adapted to accommodate a light source and an outer periphery, and a plurality of flat fingers projecting from the outer periphery, extending at an acute angle to the plane, having outer ends, and each having a pair of generally parallel side edges, the fingers abutting each other edge-wise at the side edges; and means holding the fingers with each edge of each finger closely juxtaposed with the edge of the adjacent finger and the fingers forming with the annular part a concave shape.

18. The reflector defined in claim 1 wherein the sheet metal is aluminum and the front face is mirrored, fine-matte brushed, ground, or etched matte.

19. The reflector defined in claim 10 wherein each of the fingers is trapezoidal and of a width increasing outward from the central part.

20. The reflector defined in claim 1 wherein the central part is formed with a hole adapted to accommodate the light source.

21. A reflector comprising:

a one-piece sheet-metal body having an anodized front face and unitarily formed with a central annular part lying generally in a plane and having an inner periphery generally centered on an axis and adapted to accommodate a light source and an outer periphery, and a plurality of flat fingers projecting from the outer periphery, extending at an acute angle to the plane, having outer ends, and each having a pair of generally parallel side edges; and a ring surrounding the outer ends of the fingers and holding the fingers with each edge of each finger closely juxtaposed with the edge of the adjacent finger and the fingers forming with the annular part a concave shape.

22. The reflector defined in claim 21 wherein the ring is circular and is formed with at least two radially inwardly projecting tabs, the fingers forming respective cutouts into which the tabs fit.

23. The reflector defined in claim 21 wherein there are three such angularly equispaced tabs and three such respective cutouts.

24. The reflector defined in claim 23 wherein the cutouts are formed at side edges between adjacent fingers.

25. The reflector defined in claim 22 wherein the ring has an outside diameter greater than an outside diameter formed by the outer ends of the fingers.

26. The reflector defined in claim 22 wherein the ring has an outside diameter smaller than an outside diameter formed by the outer ends of the fingers.

27. The reflector defined in claim 22 wherein the ring is substantially planar.

* * * * *